US006001448A

United States Patent [19]

Zigerlig

[11] Patent Number: 6,001,448

[45] Date of Patent: Dec. 14, 1999

[54] CLEANING ELEMENT FOR ROTATING BRUSH, MADE OF AN ETHYLENE VINYL ACETATE (EVA) COPOLYMER

[75] Inventor: Max Zigerlig, Tenero, Switzerland

[73] Assignee: Nowiteck Establishment, Vaduz, Liechtenstein

[21] Appl. No.: 08/821,305

[22] Filed: Mar. 20, 1997

[30] Foreign Application Priority Data

Mar. 13, 1997 [CH] Switzerland ..... 606/97

[51] Int. Cl.[6] ..... A46B 3/04; A46B 13/00; A46B 13/02

[52] U.S. Cl. ..... 428/67; 521/142

[58] Field of Search ..... 428/115, 116, 428/131, 192, 67; 521/142

[56] References Cited

U.S. PATENT DOCUMENTS 3,577,839 5/1971 Charvat et al. .

3,724,105 4/1973 Weight .

3,912,667 10/1975 Spitzer et al. .

FOREIGN PATENT DOCUMENTS 61-271157 12/1986 Japan .

OTHER PUBLICATIONS

"How the Footwear Industry Uses Elvax Resins", 6 pages, Du Pont Company, Aug. 1984 brochures.

"Celogen and Kempore, Chemical Blowing Agents, Methods of Expanding Rubber", pp. 1–43, Uniroyal Chemical Company, Inc., Oct. 1993 brochure.

*Primary Examiner*—Jeffrey C. Mullis

*Attorney, Agent, or Firm*—Young & Thompson

[57] ABSTRACT

A flexible cleaning element for rotating brushes for automatic washing of vehicles, suitable for being attached to a rotating support and made of an expanded closed-cell synthetic resin is provided. The expanded synthetic resin includes a copolymer that is obtained by adding vinyl acetate to it.

5 Claims, 1 Drawing Sheet

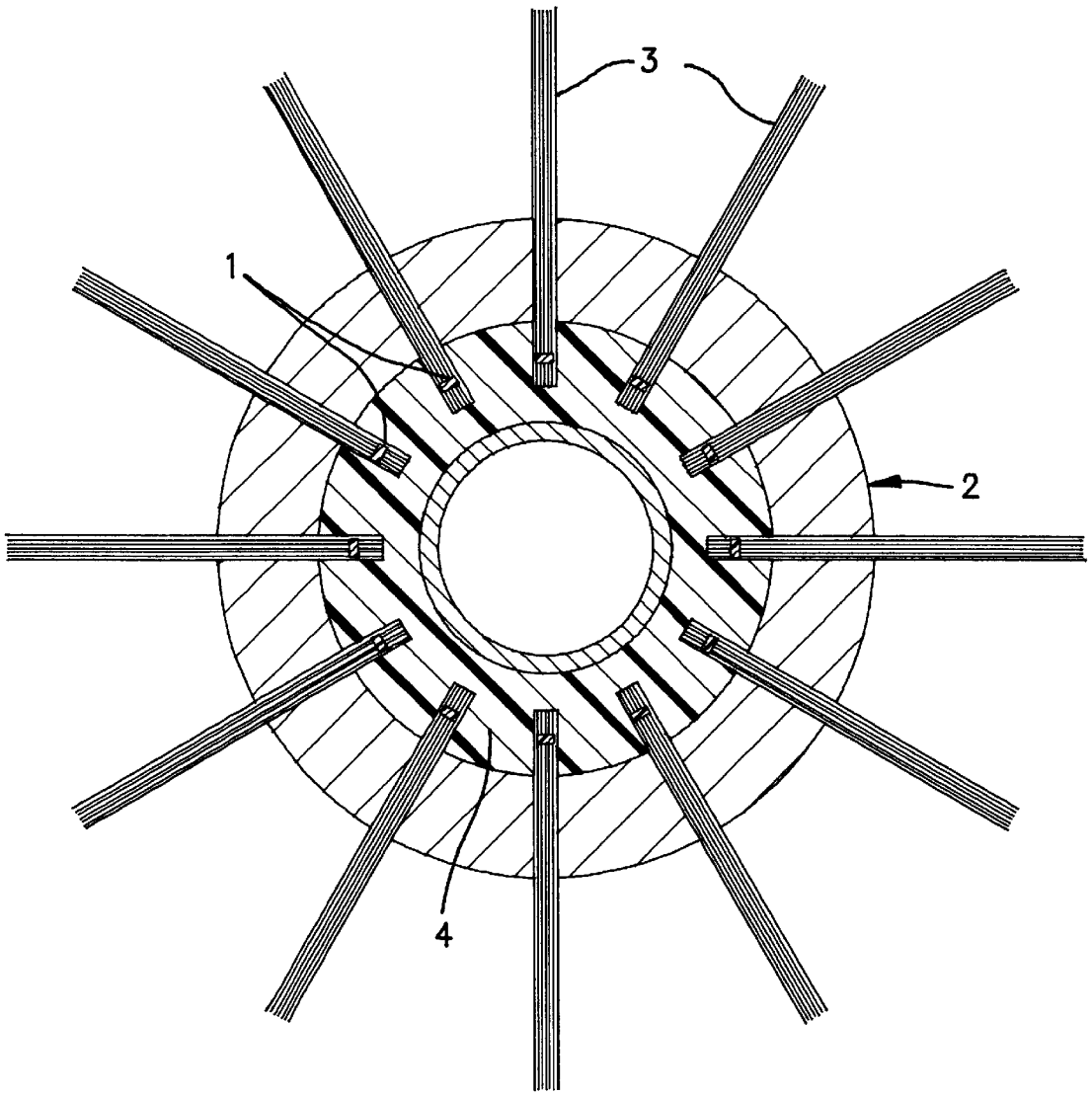
1
2
3
4

CLEANING ELEMENT FOR ROTATING BRUSH, MADE OF AN ETHYLENE VINYL ACETATE (EVA) COPOLYMER

BACKGROUND OF THE INVENTION

This invention pertains to cleaning elements for rotating brushes that are used in particular in automatic car washing systems.

When in use, these elements, which are in the form of wires, strips, or fringed sheets, are subjected to many stresses which, in addition to the traction caused by centrifugal force and bending, include abrasion and the impacts that said elements undergo when they come into contact with the surfaces to be cleaned.

Another aspect that is critical for a cleaning element is the fact that it has to be attached at one end to a rotating support device: at the attachment point, the cleaning element itself necessarily experiences a significant, unavoidable compression that is located close to, among other things, the part of said element that is extensively subjected to the resultant overall traction force, bending, and shearing.

Said elements should above all be made of absolutely non-abrasive materials and should be designed in such a way as not to incorporate the potentially abrasive particles that are removed during washing and not to absorb the washing water which, in addition to making said elements heavier, thereby aggravating the stresses acting on them, can freeze, irrigating the elements and completely compromising their function.

DESCRIPTION OF THE RELATED ART

According to the state of the art, in order to minimize the above-mentioned risks and drawbacks, said cleaning elements are made of closed macrocellular expanded synthetic resins, i.e., polymers for example, such as polyethylene, polypropylene, etc.

It has been found that, when such materials are used, it is necessary to produce the cleaning element with a relatively large thickness (up to 4–5 millimeters), with macrocells of considerable diameter owing to the type of process that is used to make the materials themselves (extrusion), and this means that the flexibility of the elements is not always satisfactory and that the action of said elements on the vehicle body when they come into contact with it is relatively rough.

Being aware of the characteristics of surface softness and resistance to abrasion of ethylene vinyl acetate (EVA) , which characteristics are currently being exploited by using such materials to coat relatively stiff inner parts such as brush bristles and high-tech toothbrushes, the inventor has conceived of the idea of utilizing vinyl acetate by adding ethylene to one of the synthetic resins that is currently used to make cleaning elements for rotating brushes in order to obtain a copolymer which, by itself or mixed with other substances that then enhance its physical-mechanical characteristics and that will be described below, proves to be suitable for making the above-described cleaning elements, offering considerably higher levels of performance than can be obtained under the current state of the art.

During the process of the preparation of the ethylene vinyl acetate copolymer and during its reticulation in a pressurization phase (which is accomplished by admixing substances such as special peroxides) in order to produce a cleaning element, the ethylene vinyl acetate copolymer that is formed by the above-described addition operation exhibits in cross-section an agglomerate of closed microcells that have a diameter which is considerably smaller than those of the materials currently used, with a considerably larger overall cross-section of material that is resistant to traction and bending stress.

This means that it is possible to reduce the cross-section of the cleaning element, with greater flexibility and less stress arising from the bending stresses that act on its outermost edges.

All of this, combined with the qualities of softness that are ensured by the presence of the vinyl acetate, makes the ethylene vinyl acetate copolymer the ideal material for producing flexible cleaning elements for rotating brushes.

Above all, a copolymer as described above, i.e., an EVA copolymer, exhibits excellent characteristics of resistance to aggressive chemical agents and to atmospheric agents, especially exposure to radiation (including solar radiation).

SUMMARY OF THE INVENTION

The object of this invention is thus a flexible cleaning element for rotating brushes for automatic washing of vehicles, whereby said element is suitable for being attached to a rotating support element and is made of a closed-cell expanded synthetic resin which includes an ethylene vinyl acetate copolymer.

BRIEF DESCRIPTION OF THE DRAWINGS

Some preferred embodiments of the object of the invention will now be described in greater detail. In order to ensure better visualization of a flexible element and an example of the attachment of it to a rotating brush, reference is also made to the attached FIGURE, which shows the cross-section of one of the many possible embodiments of the latter that are already known.

DESCRIPTION OF THE PREFERRED EMBODIMENTS

Flexible elements 3 of a known type in the shape of a fringed sheet are attached at one end to a support 2 with the system shown in the FIGURE, i.e., leaving at said end one or more holes 1 through which runs material 4 (for instance, polyurethane) which is injected into support 2 itself, which thus connects each element 3 to the latter.

This kind of anchoring can be accomplished by folding along the mid-line a fringed sheet at two ends in such a way that a single sheet forms a handle and creates two flexible elements that are attached to said support by the handle, which is equipped with holes whose function is exactly the same as those described in the previous case (this solution is not shown).

According to some preferred embodiments, said elements are made of said EVA copolymer, with which are mixed other chemical additives and, in some cases, natural or synthetic rubber.

The latter substance then enhances the physical-mechanical characteristics of the cleaning element, while other substances, which will be listed below, are employed in order to ensure the reticulation of the EVA copolymer or act as "loads" to enhance particular mechanical-resistance characteristics.

Finally, other substances such as stearin or stearic acid are added in order to make the mixture better suited to the washing cycle that is required to produce flexible cleaning elements as described above.

In a preferred embodiment of the cleaning element according to the invention, the synthetic resin of which it is made contains:

approx. 80% by weight of said copolymer (EVA), which in turn contains 9–28% of its weight in vinyl acetate;

approx. 10% by weight of amorphous precipitated silica;

approx. 2% by weight of bis(tert-butyl peroxyiso-propyl) benzene;

approx. 2.5% by weight of azodicarbonamide;

approx. 0.5% by weight of stearin;

approx. 5% by weight of pigments.

According to another preferred embodiment, the synthetic resin contains:

approx. 60% by weight of said copolymer (EVA), which in turn contains 9–28% of vinyl acetate;

approx. 20% by weight of natural or synthetic rubber;

approx. 10% by weight of amorphous precipitated silica;

approx. 2% by weight of bis(tert-butyl peroxyiso-propyl) benzene;

approx. 2.5% by weight of azodicarbonamide;

approx. 0.5% by weight of stearin;

approx. 5% by weight of pigments.

In another embodiment, the synthetic resin contains:

approx. 47% by weight of said copolymer (EVA), which in turn contains 9–28% of vinyl acetate;

approx. 5% by weight of low-density polyethylene (PE);

approx. 40% by weight of amorphous precipitated silica;

approx. 1.1% by weight of stearic acid;

approx. 2% by weight of zinc oxide;

approx. 3% by weight of azodicarbonamide;

approx. 2% by weight of bis(tert-butyl peroxyiso-propyl) benzene.

In order to obtain a flexible cleaning element according to the invention that offers comprehensively better performance, on the basis of tests the inventor suggests that a proportion by weight of vinyl acetate of approximately 18% of the total weight of the EVA copolymer be used.

Other substances such as pigments, etc. can be selected from among those known to one skilled in the art for this area of application.

The inventor also suggests that the above-mentioned amorphous precipitated silica be used as "load" fibers.

Clearly, it is possible to produce many other embodiments of a synthetic resin that contains an EVA copolymer according to what is described in the attached claims and that is suitable for making flexible cleaning elements for rotating brushes.

If these embodiments are based on the concepts set forth in the attached claims, said embodiments are still within the scope of the protection conferred by the attached patent application.

I claim:

1. A flexible cleaning element, suitable for attachment to a rotating support for rotating brushes, used for automatic washing of vehicles, comprising an expanded closed-cell synthetic resin, wherein said expanded closed-cell synthetic resin includes an ethylene vinyl acetate copolymer containing approximately 80% by weight of said ethylene vinyl acetate copolymer, which in turn contains 9–28% of its weight in vinyl acetate and further comprises:

approximately 10% by weight of amorphous precipitated silica;

approximately 2% by weight of bis(tert-butyl peroxyiso-propyl) benzene;

approximately 2.5% by weight of azodicarbonamide;

approximately 0.5% by weight of stearin; and approximately 5% by weight of pigments.

2. A flexible cleaning element, suitable for attachment to a rotating support for rotating brushes, used for automatic washing of vehicles, comprising an expanded closed-cell synthetic resin, wherein said expanded closed-cell synthetic resin includes an ethylene vinyl acetate copolymer containing approximately 60% by weight of said ethylene vinyl acetate copolymer, which in turn contains 9–28% of its weight in vinyl acetate and further comprises:

approximately 20% by weight of natural or synthetic rubber;

approximately 10% by weight of amorphous precipitated silica;

approximately 2% by weight of bis(tert-butyl peroxyiso-propyl) benzene;

approximately 2.5% by weight of azodicarbonamide;

approximately 0.5% by weight of stearin; and approximately 5% by weight of pigments.

3. Cleaning element according to claim 2, in which said ethylene vinyl acetate copolymer contains 18% by weight of vinyl acetate.

4. A flexible cleaning element, suitable for attachment to a rotating support for rotating brushes, used for automatic washing of vehicles, comprising an expanded closed-cell synthetic resin, wherein said expanded closed-cell synthetic resin includes an ethylene vinyl acetate copolymer containing approximately 47% by weight of said ethylene vinyl acetate copolymer, which in turn contains 9–28% by weight of vinyl acetate and further comprises:

approximately 5% by weight of low-density polyethylene;

approximately 40% by weight of amorphous precipitated silica;

approximately 1.1% by weight of stearic acid;

approximately 2% by weight of zinc oxide;

approximately 3% by weight of azodicarbonamide; and approximately 2% by weight of bis(tert-butyl peroxyiso-propyl) benzene.

5. Cleaning element according to claim 4, in which said ethylene vinyl acetate copolymer contains 18% by weight of vinyl acetate.

* * * * *